United States Patent [19]

Reinert

[11] 4,358,335

[45] Nov. 9, 1982

[54] FABRIC REPAIRING ASSEMBLY

[75] Inventor: Gerhard Reinert, Bayside, N.Y.

[73] Assignee: The Singer Company, Stamford, Conn.

[21] Appl. No.: 284,877

[22] Filed: Jul. 20, 1981

[51] Int. Cl.[3] ..... B32B 35/00

[52] U.S. Cl. ..... 156/514; 83/520; 156/98; 156/256; 156/379; 156/583.1; 219/201; 219/227; 428/63

[58] Field of Search ..... 29/402.11; 81/15.7; 83/520; 156/98, 510, 513, 514, 379, 256, 583.1; 219/201, 227; 428/63

[56] References Cited

U.S. PATENT DOCUMENTS

| | | | |
|---|---|---|---|
| 138,357 | 4/1873 | Allen . | |
| 1,113,030 | 10/1914 | McLaurin . | |
| 2,311,600 | 2/1943 | Shook | 156/514 X |
| 2,649,876 | 8/1953 | Thompson et al. . | |
| 2,759,090 | 8/1956 | Frye . | |
| 2,924,694 | 2/1960 | Kreider . | |
| 3,138,505 | 6/1964 | Hirsch | 428/63 X |
| 3,271,217 | 9/1966 | Mapson | 156/98 |
| 3,513,048 | 5/1970 | Snyder | 156/98 |
| 3,558,385 | 1/1971 | Ronning | 156/98 |
| 3,616,084 | 10/1971 | Rogers | 156/514 |
| 3,697,358 | 10/1972 | Ronning | 156/514 |
| 3,734,795 | 5/1973 | Griffith | 156/98 |
| 3,772,114 | 11/1973 | Kowalchuk | 156/98 |
| 4,036,674 | 7/1977 | Labenz | 156/98 |
| 4,047,300 | 9/1977 | Sweeney | 156/98 X |
| 4,058,423 | 11/1977 | Bascom et al. | 156/98 |

*Primary Examiner*—Robert A. Dawson

*Attorney, Agent, or Firm*—William V. Ebs; Robert E. Smith; Edward L. Bell

[57] ABSTRACT

A fabric repairing assembly is provided with an impact cutter which is operable by a plunger that is slidably mounted in an embracing housing. The assembly is further provided with a heater which includes a sleeve that slidably receives the said housing and wherein the housing can be moved to cause the plunger to press the heater against cloth undergoing repair.

10 Claims, 11 Drawing Figures

FABRIC REPAIRING ASSEMBLY

BACKGROUND OF THE INVENTION

1. Field of the Invention

The invention relates to fabric repairing devices, and more particularly, to devices for use in repairing a damaged area of a fabric with a patch taken from fabric which is the same as the damaged fabric.

2. Description of the Prior Art

It is well known to repair a damaged garment by first punching a hole in the fabric at the damaged site of sufficient size to include all of the damaged area, and to then punch out a patch identical in size and shape to such hole for use in making the repair from fabric which is the same as the damaged fabric. The patch is preferably obtained from an unnoticeable part of the damaged garment to assure a match at the damaged site. A support pad impregnated with a thermoplastic adhesive is placed under the hole, and the patch is placed in the hole, after which heat is momentarily applied to the patch to melt the thermoplastic adhesive and cause it to flow into the interstices of adjacent portions of the garment and patch to complete the repair. The apparatus used in repairing a garment as described has consisted of a hole punching or cutting device and a heated pressing iron as separate pieces of equipment such as described for example, in U.S. Pat. Nos. 4,047,300 and 3,513,048, respectively.

It is a prime object of the present invention to provide a compact, convenient-to-use assembly of interacting parts capable of performing in an improved manner the aforementioned hole punching or cutting, heating and pressing functions during the repair of a garment as described.

Various, more specific objectives of the invention will become apparent during a reading of the specification taken in connection with the accompanying drawings.

SUMMARY OF THE INVENTION

A fabric repairing assembly according to the invention includes a support surface, a housing, a cutter in one end of the housing, and a manually operable plunger extending from the other end of the housing and movable in the housing for causing the cutter to impact against a damaged portion of fabric supported on said surface and thereby cut out a part of the fabric including the damaged area, and for moving the cutter against an undamaged portion of the fabric supported on said surface to cut out a patch for the hole made in the damaged portion. The assembly further includes a heating and pressing unit with a sleeve extension wherein said housing can be moved while inverted to cause the plunger to apply a force against the heater and the heater to press against the aforesaid patch when located in the said hole in an overlying relationship with an adhesive pad resting on the said support surface. Movement of the housing in said sleeve extension turns the heater on.

DESCRIPTION OF THE PREFERRED EMBODIMENT

Figure 1:
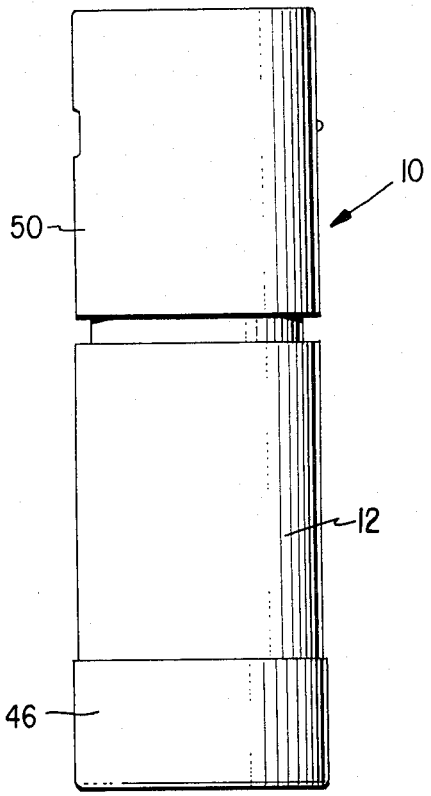
FIG. 1 is an elevational view of a fabric repair assembly according to the invention.
Figure 2:
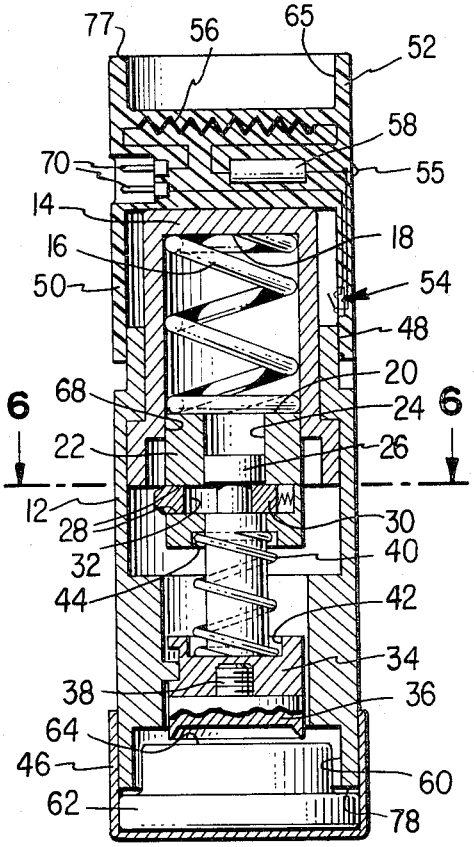
FIG. 2 is a vertical longitudinal sectional view taken through the assembly of FIG. 1.
Figure 3:
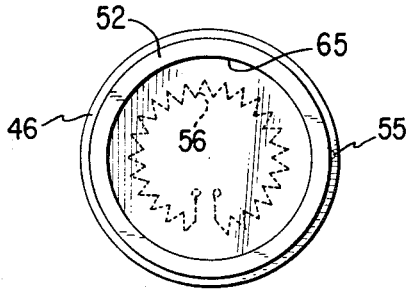
FIG. 3 is a top plan view of the assembly of FIG. 1.
Figure 4:
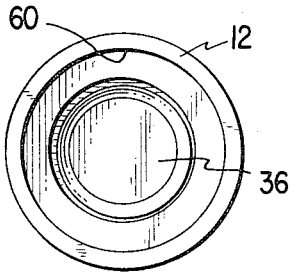
FIG. 4 is a bottom view thereof taken with a cover and fabric supporting anvil removed from the assembly.
Figure 5:
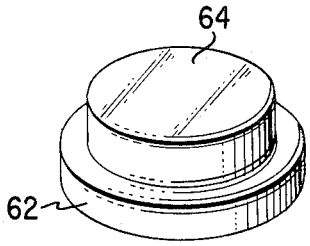
FIG. 5 is a perspective view of the anvil.
Figure 6:
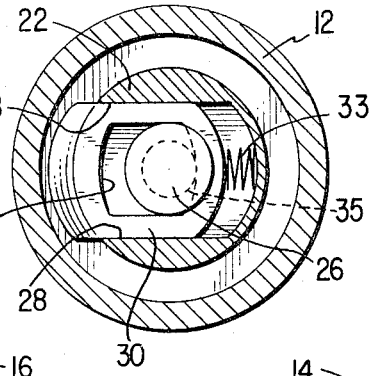
FIG. 6 is a sectional view taken substantially on the plane of the line 6—6 of FIG. 2 and showing a latch in an unactuated position.
Figure 7:
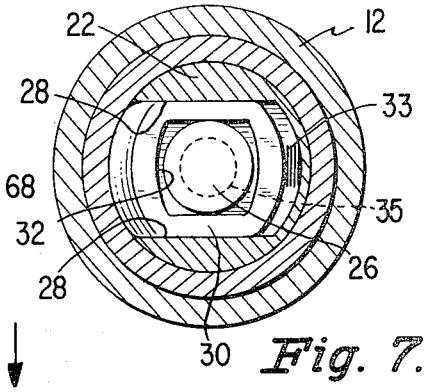
FIG. 7 is a view similar to FIG. 6 showing the latch actuated.

Referring to the drawings, and especially to FIGS. 1 and 2 reference character 10 designates an assembly according to the invention for use in the repairing of a damaged garment. Such assembly includes a housing 12, and a hollow plunger 14 which is slidable within the housing. A spring 16 is located in the plunger where one end engages an end wall 18 of the plunger and the opposite end engages an end surface 20 of a hammer 22. The hammer includes a longitudinal through hole 24 wherein one end portion of a shaft 26 is received, and further includes a transverse blind ended slot 28 wherein a slidable latch 30 is received. Latch 30 includes an elongate hole 32 which accommodates shaft 26. In an unactuated position, the latch is in alignment with and is biased by a spring 33 into engagement with a reduced diameter portion 35 of the shaft (see FIG. 6). The latch is then effective to prevent relative axial movement of the hammer and shaft. In an actuated position of the latch brought about by movement of plunger 14 as hereinafter described, elongate hole 32 in the latch is disposed in a position permitting the shaft and hammer to slide on the shaft (FIG. 7).

Shaft 26 is secured to a cutter 34 having a blade 36 affixed thereto by a screw 38. A light spring 40 is provided between the cutter and hammer 22. As shown, one end of spring 40 extends into an annular recess 42 in the cutter 34 and the opposite end extends into a recess 44 in the hammer. A cover 46 is provided for the end of housing 12 wherein the cutter is located. The opposite end of the housing is adapted at 48 to slide within the sleeve 50 of a fabric heating and pressing unit 52. Unit 52 includes a switch 54, a light bulb 55, an electric heating element 56, and a conventional type timer 58 effective in a series circuit to open the circuit a predetermined period of time after it is energized, and to maintain the circuit open until it is reenergized. Switch 54 is disposed in sleeve 50 for operation by the housing 12.

Housing 12, at the end wherein the cutter 34 is located, is provided with a recess 60 wherein an anvil 62 with a fabric support surface 64 is accommodated. Preferably, housing 12 is constructed of a transparent plastic material permitting one to view fabric when placed on the anvil below the cutter, and to adjust the fabric relative to the cutter as may appear desireable. At the end of assembly 10 opposite from the cutter containing end, the sleeve 50 of heating and pressing unit 52 is provided with another recess 65 similar to the recess 60.

Figure 8:
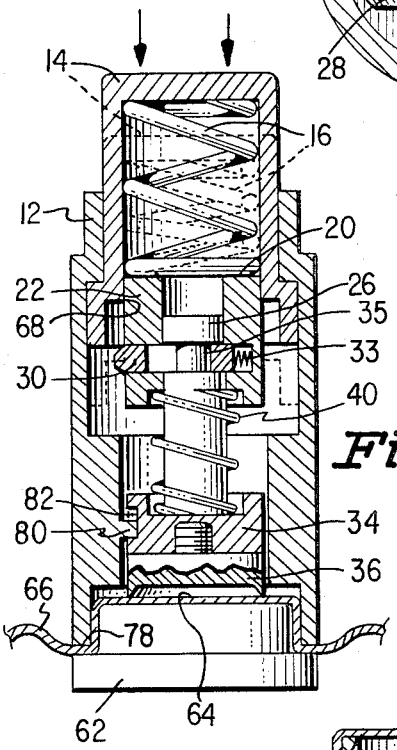
FIG. 8 is a vertical longitudinal sectional view showing the assembly readied for a hole cutting operation.
Figure 9:
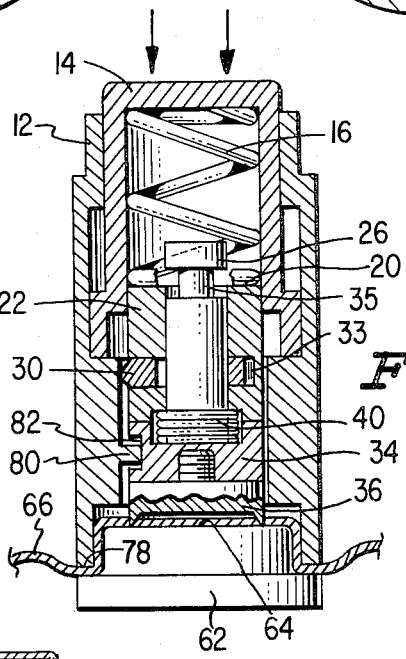
FIG. 9 is a view similar to FIG. 8 showing the mechanism of the assembly in an actuated condition.
Figure 10:
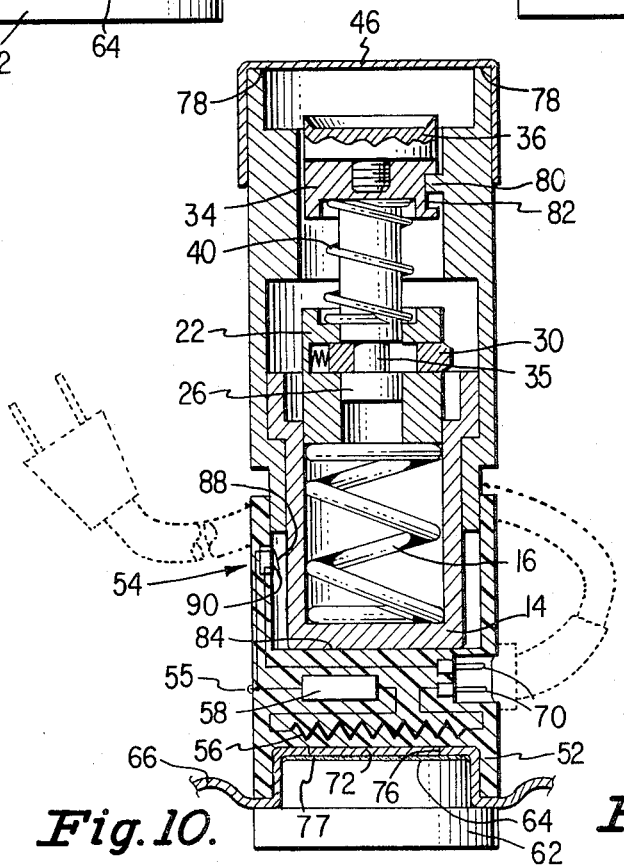
FIG. 10 is a vertical longitudinal sectional view showing the assembly readied for a heating and pressing operation.
Figure 11:
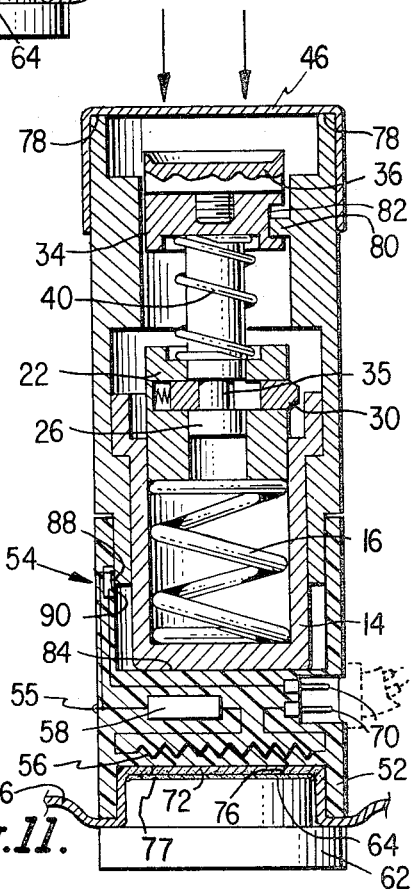
FIG. 11 is a view similar to FIG. 10 showing mechanism of the assembly in operational positions during the heating and repairing of materials at a repair site.

The assembly 10 is used to repair a garment, first with the heating and pressing unit 52 removed from housing 12, and then with unit 52 in place. The assembly is used without unit 52 both to remove a damaged area of a fabric and to remove a patch of fabric corresponding to that removed at the damaged site. With the housing 12 lifted from the anvil 62 and cover 46 removed, fabric 66 is positioned on the support surface 64 of the anvil after which the housing is repositioned over the fabric covered anvil as in FIG. 8. Hand pressure is applied to the plunger 14 and the plunger acting through spring 16, hammer 22, latch 30 and shaft 26 causes the cutter to bear against fabric 66 on the anvil. The plunger moves downwardly in the housing, spring 16 is compressed against the hammer, and latch 30 is actuated by plunger wall 68. The latch is moved in slot 28 against a spring 33 by the plunger wall and latch hole 32 is thereby brought into alignment with shaft 26 whereupon the hammer 22 is suddenly thrust downwardly with the latch by stored energy in spring 16 and caused to impact against the cutter. The cutter thereupon drives the cutter blade through fabric 66 to cut out a portion of the fabric as defined by the outline of the blade. Spring 40 is compressed during downward movement of the hammer and serves after completion of the impact cutting operation to return the hammer and plunger to the positions they occupied before the operation was initiated. As latch 30 is realigned with reduced diameter portion 33 of shaft 26, spring 33 becomes effective to move the latch back into its unactuated position preventing movement of the hammer on the shaft.

The assembly 10 is used in an inverted position with the cover 46 over the cutter containing end of housing 12, the heating and pressing unit 52 in place at the other end of the housing, and the circuit for unit 52 connected to an electrical supply line at prongs 70 when a patch 72 (corresponding in size to a hole 76 in fabric 66 made by the cutter blade) is to be attached to a thermoplastic impregnated support pad 77 disposed under the hole. The assembly is disposed to receive the anvil and materials supported thereon in housing recess 65. Hand pressure is applied to cover 46 to cause the cover to act against the housing at 78 and move the housing down the plunger. As the housing is so moved a key 80 on the housing in a slot 82 in the cutter 34 is caused to engage an end wall of the slot and force is transmitted to plunger 14 through the cutter, shaft 26, latch 30, hammer 22, and the spring 16 which is compressed against the plunger in the process. The plunger bears against surface 84 of heating and pressing unit 52, and the unit presses against the materials on the anvil. The housing is moved downwardly by the hand pressure on the cover until housing end portion 86 is caused to close spring contact 88 of switch 54 against contact 90 and so complete an energizing circuit including light bulb 55, timer 58, and heating element 56. After a predetermined period of time as defined by the timer the circuit is opened and bulb 55 is extinguished to indicate to an operator that a proper length of time has elapsed for the melting of the thermoplastic material in pad 77 and the securing of the pad to the fabric 66 and of the patch 72 to the pad as required to complete the repair. Hand pressure is removed from the cover 46 to permit the various parts of the assembly 10 to be returned to normal positions. The housing is lifted from the anvil and the repair fabric is removed from the anvil.

It is to be understood that the present disclosure relates to a preferred embodiment of the invention which is for purposes of illustration only and is not to be construed as a limitation of the invention. Numerous alterations and modifications of the structures herein disclosed will suggest themselves to those skilled in the art, and all such modifications and alterations which do not depart from the spirit and scope of the invention are intended to be included within the scope of the appended claims.

I claim:

1. A fabric repairing assembly including a support surface, a housing, a cutter in one end of the housing, a manually operable plunger extending from the other end of the housing and movable therein for causing the cutter to move against a damaged portion of fabric supported on said surface and cut out a part of the fabric including the damaged area, and for moving the cutter against an undamaged portion of the fabric supported on said surface to cut out a patch for the hole made in the damaged portion, and a heating and pressing unit including a sleeve formed slidably to accommodate the other end of said housing wherein said housing can be moved relatively to said sleeve to cause the plunger to apply a force against the heating and pressing unit and the heating and pressing unit to press against the aforesaid patch when located in the said hole in an overlying relationship with an adhesive pad resting on the a support surface.

2. A fabric assembly as defined in claim 1 including means in association with said plunger for applying an impact force to the cutter upon movement of the plunger to a predetermined position in the housing.

3. A fabric assembly as defined in claim 2 wherein the means in association with said plunger for applying an impact force to the cutter includes a spring for storing energy during movement of the plunger to the said predetermined position, and means for releasing the energy in said spring upon attainment of the predetermined position by the plunger.

4. A fabric assembly as defined in claim 3 wherein the means for applying an impact force includes a hammer movable by said spring from an initial position apart from the cutter into engagement with the cutter, and a second spring for returning the hammer to its initial position.

5. A fabric repairing assembly as defined in claim 1 including a switch on the heating and pressing unit actuable by movement of the housing.

6. A fabric repairing assembly as defined in claim 5 wherein the switch is mounted in the sleeve.

7. A fabric repairing assembly as defined in claim 1 wherein the housing is transparent at least in part and permits an operator to view fabric on said support surface.

8. A fabric repairing assembly as defined in claim 1 wherein the housing is adapted at said one end to envelop the support surface.

9. A fabric repairing assembly as defined in claim 1 including a cover for said one end of the housing.

10. A fabric repairing assembly including an anvil member having a fabric supporting surface, a housing formed at one end with a recess to accommodate said anvil member, a cutter in said one end of said housing, a manually operable plunger extending from the other end of said housing and movable therein for causing the cutter to move against a damaged portion of fabric supported on said fabric supporting anvil surface and cut out a part of the fabric including the damaged area, and for moving the cutter against an undamaged portion of the fabric supported on said fabric supporting anvil surface to cut out a patch for the hole made in the damaged portion, and a heating and pressing unit formed at one end with a recess to accommodate said anvil member and at the other end including a sleeve slidably accommodating the other end of said housing wherein said housing can be moved to cause the plunger to apply a force against the heating and pressing unit and the heating and pressing unit to press against the aforesaid patch when located in the said hole in an overlying relationship with an adhesive pad resting on said fabric supporting surface of an anvil accommodated in said recess of the heating and pressing unit.

* * * * *